United States Patent [19]

Martensson et al.

[11] Patent Number: 4,920,352

[45] Date of Patent: Apr. 24, 1990

[54] RETRACTABLE ANTENNA

[75] Inventors: Nils E. V. Martensson, Long Acre; Michael B. Ashdown, Kingshill, both of England

[73] Assignee: Technophone Limited, United Kingdom

[21] Appl. No.: 351,866

[22] Filed: May 12, 1989

[30] Foreign Application Priority Data

May 27, 1988 [GB] United Kingdom ..... 8812703

[51] Int. Cl.[5] ..... H01Q 1/24

[52] U.S. Cl. ..... 343/702; 343/903

[58] Field of Search ..... 343/702, 900, 901, 903; 455/89, 90

[56] References Cited

U.S. PATENT DOCUMENTS

| | | | |
|---|---|---|---|
| 3,087,117 | 4/1963 | Mitchell | 343/702 |
| 3,522,222 | 9/1950 | Haller | 343/903 |
| 3,946,390 | 3/1976 | Alexander et al. | 343/702 |
| 4,125,845 | 2/1988 | Phillips | 343/702 |
| 4,225,871 | 9/1980 | Ramari | 343/903 |

FOREIGN PATENT DOCUMENTS

| | | |
|---|---|---|
| 2323612 | 11/1974 | Fed. Rep. of Germany . |
| 2311419 | 5/1975 | France . |
| 2406317 | 10/1977 | France . |
| 0844968 | 8/1960 | United Kingdom . |
| 1366089 | 10/1971 | United Kingdom . |

*Primary Examiner*—Rolf Hille
*Assistant Examiner*—Doris J. Johnson
*Attorney, Agent, or Firm*—Perman & Green

[57] ABSTRACT

A retractable antenna is in the form of a tape (7) which is slidably mounted in a passageway (6). An electrical contact (9) for making connection to the antenna is provided on the rear wall (3) of the passageway. The tape (7) or the passageway (6) or both are shaped so as to form a bend, e.g. a bow, across the width of the tape so that (a) the convex side of the tape confronts the contact (9) and (b) rigidity is imparted to the tape to keep it upright when extended from the passageway. This antenna is slim and lightweight and therefore ideally suited for use with a compact portable radio telephone.

20 Claims, 3 Drawing Sheets

RETRACTABLE ANTENNA

BACKGROUND OF THE INVENTION

This invention relates to an antenna assembly comprising a retractable antenna which may be applied, for example, to a portable radio and, in particular a hand portable radio telephone.

A radio intended for two-way communication generally operates with either an external fixed rod or retractable antenna, or with an internal antenna. The fixed rod type of antenna has a predetermined length. Whilst such antennas can be relatively short, they are not conductive to a compact design nor are they particularly suitable for a radio intended to be carried in a pocket or other receptacle offering restricted space. On the other hand, retractable antennas are convenient for this purpose because they can be folded away when the radio is not in use. Retractable antennas are commonly of the telescopic tube type, although retractable fixed length antennas are also known. For example, the published French applications FR-A-2,406,317 and FR-A-2,311,419 both disclose a retractable antenna in the form of a tape which can be wound up into a spiral. However, these known kinds of retractable antenna are more difficult and expensive to produce, and sufficient space must be provided within the radio casing to accommodate the antenna in its retracted form. This can contribute significantly to the overall bulk and weight and to the expense of the radio.

SUMMARY OF THE INVENTION

According to a first aspect of the present invention there is provided an antenna assembly comprising an antenna support and an antenna retractably mounted on said support, the antenna being in the form of a tape, the support defining a passageway in which the tape is received, and contact means for making a connection to the antenna being provided on the support in the passageway, wherein the tape, or the passageway, or both are shaped so as to impose a bend transversely across the tape at least in the region of the contact means such that the convex side of the tape confronts the contact means and rigidity is imparted to the tape when extended from the passageway.

An antenna assembly in accordance with the invention has the advantage that it can be compact and lightweight and so ideally suited for use with a portable radio. Also, it is relatively straightforward and inexpensive to manufacture.

The transverse bend of the tape not only promotes rigidity when the tape is extended, but—in view of the disposition within the passageway—also provides a resilience which urges the tape towards the contact means to provide a good electrical connection. Additionally, the contact means may be resiliently biased towards the antenna to further ensure a good connection.

In one embodiment, the passageway has at least one dimension which tends to distort the cross-section of the tape. This tends to retain the tape within the passageway when the antenna is either extended or retracted. However, it can also impart rigidity to a flat tape, as discussed in more detail below.

The tape may have a pre-configured cross-section at least to provide the tape with rigidity when extended from the passageway. For example, the cross-section may be bowed, i.e. arcuate in shape. Alernatively, it may be angular, such as a shallow V or it may be corrugated for the same purpose. However, instead of using a tape with a pre-configured cross-section, the passageway may be shaped so as to impart a predetermined bend configuration to the cross-section of the tape, e.g. an arcuate or V-shape.

According to a further aspect of the invention there is provided a radio having a main casing and incorporating the antenna assembly in accordance with the first aspect, the passageway being defined by walls which are either integral with or attached to the main casing. If the antenna is longer than the longest dimension of the radio, the passageway may be adapted to bend the antenna in the length direction around the profile of the casing when the antenna is, or is being, retracted. To this end it may be preferable if the passageway is adapted to impose along its length a gradually decreasing curvature of the bend in the cross-section of the tape away from the end of the passageway from which the antenna is extendible, even to the extent that it may become completely flat, to facilitate bending the tape in its length direction around the casing.

Whilst the antenna would normally be manually extended and retracted, means such as a spring or motor driven reel could also be provided for automatically extending and/or retracting the tape.

In a preferred embodiment the contact means is disposed locally adjacent the end of the passageway from which the antenna is extendible and the antenna is provided with an insulating coating. A window is present in the coating on the convex side of the antenna adjacent one end thereof to permit the contact means to make the antenna connection when the antenna is fully extended. Thus the antenna is connected and operable only when it is in its fully extended position. A further window may also be provided in the coating on the convex side of the antenna adjacent the opposite end thereof to permit the contact means to make the antenna connection when the antenna is fully retracted. The antenna is now connected and operable both when it is in its fully extended and fully retracted positions.

In order to positively locate the tape at a predetermined extended position, means may be provided for engaging the tape at a predetermined position or positions along its length.

One or more switching means may be provided in, or adjacent, said passageway for detecting the position of the antenna. This is useful where, for example, a radio incorporating the antenna assembly as well as an internal antenna may be operated with either the tape antenna or the internal antenna connected, via the switching means, to the radio circuitry. The switching means is thereby responsive to the extent of the tape so that, for example, the tape antenna is automatically connected in place of the internal antenna when the tape has been properly extended.

Where the tape is in the form of, or is part of a dipole, the tape may be divided into two poles and respective contacts may be provided in the passageway for engaging each pole of the tape when extended. Alternatively, the tape may form one pole of a dipole, the other pole of which is internally provided in a radio casing in the form of, for example, a metallic coating.

Embodiments of the invention will now be described, by way of example, with reference to the accompanying drawings, in which:

DESCRIPTION OF THE PREFERRED EMBODIMENTS

Whilst the preferred embodiments of the invention will be described with reference to a portable radio telephone, it will be understood that the invention can be applied more widely. For example, instead of being an integral part of, or an attachment to, a radio casing the invention may be embodied as part of an antenna assembly which is remote from a radio, e.g. as with a vehicle antenna.

Figure 1:
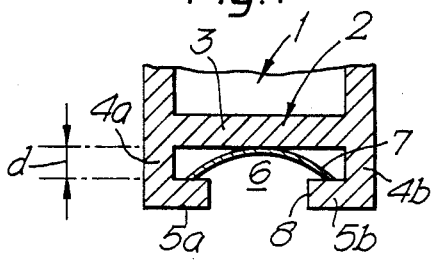
FIG. 1 is a cross-section of a part of a radio casing showing a tape antenna with a bowed cross-section mounted in a passageway.

FIGS. 1–7 all show a cross-section through part of a radio casing 1, containing conventional circuitry and components (not shown). In FIGS. 1, 2 and 4–7 the casing 1 includes an integral housing 2 having walls 3, 4*a*, 4*b*, 5*a*, 5*b* which define a T-shaped passageway in which an antenna 7 is located. In FIG. 1 the antenna 7 is in the form of a tape having a bowed or arcuate cross-section. The tape is preferably made from a thin sheet of spring metal which is electrically insulated by means of a layer or coating 17 of insulating material, see FIG. 9. In some embodiments of the invention some parts 16,18 of the tape are not insulated so that electrical connection can be made between the metallic sheet and electrical contacts, discussed in more detail below.

Figure 8:
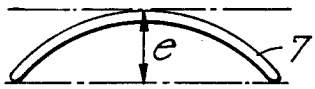
FIG. 8 is a cross-section of a bowed tape when it is not located in the passageway.

The passageway 6 has a depth dimension 'd' which is slightly less than the natural radial extent 'e' of the bowed section of tape 7, i.e. when the tape is not located in the passageway 6. The radial extent 'e' is shown in FIG. 8. The tape is then slightly distorted (compressed radially) when fitted to the passageway and this provides a degree of self-retention, e.g. for holding the tape in an extended position, or for preventing it from falling out of the passageway when retracted.

Figure 2:
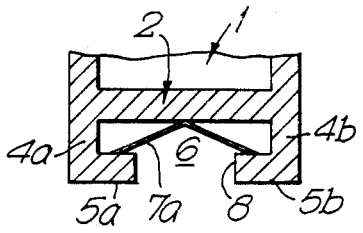
FIG. 2 shows a similar arrangement, but with a tape having a shallow V-shaped cross-section.
Figure 4:
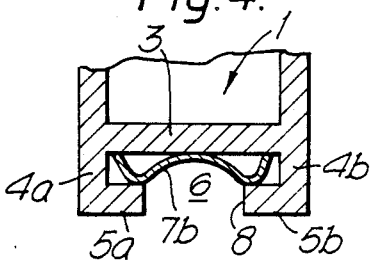
FIG. 4 is similar to FIG. 1 except that the tape has a corrugated cross-section.

The bowed or arcuate cross-section of tape 7 provides a degree of inherent rigidity (beam strength) when the antenna is extended, i.e. to prevent it from folding or flopping over. FIG. 2 shows a tape 7*a* with a shallow V-shaped cross-section and FIG. 4 shows a tape 7*b* with a corrugated cross-section. Both of these tapes have inherent rigidity and can be slightly compressed when fitted to their respective passageways.

In FIGS. 1, 2, and 4–7 the housing 2 has an opening 8 providing access to tape 7. The opening enables other component to be coupled to the radio, as disclosed for example in our co-pending application Ser. No. 07/351,434, entitled "Antenna Assembly" by the same inventors as herein and assigned to he same assignee as herein, filed concurrently herewith, which claims priority from UK application No. 8812703 filed May 27, 1988. However, the passageway need not have such an opening, but may instead fully enclose the antenna as seen in cross-section.

Figure 3:
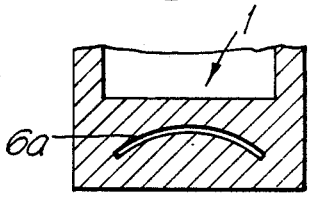
FIG. 3 is a cross-section of another embodiment in which a flat tape (not shown) is located in an arcuate passageway.

As an alternative to using a tape with a configured cross-section, a flat tape 7*c* can be fitted into a passageway having an arcuate section as shown in FIG. 3. Since the tape will tend to take up its natural flat shape, a degree of self-retention is provided. Moreover, although the tape will lose rigidity the further it is extended, as long as it is not extended too far, the lower portion of the extended tape (close to the passageway) will be configured into a curve that tends to prevent folding of the tape. The passageway 6*a* need not have an arcuate shape (as shown). For example, a flat tape wider than the passageway 6 (of FIG. 1) could be curved into an arc before sliding it into passageway 6. The lateral edges of that ape would then abut the corners of the passageway 6 and (preferably) the center portion of the tape would contact the rear wall 3.

Figure 5:
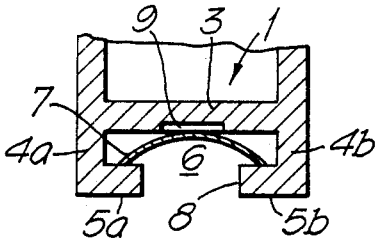
FIG. 5 is a similar view to that of FIG. 1, but also shows an electrical contact.
Figure 9:
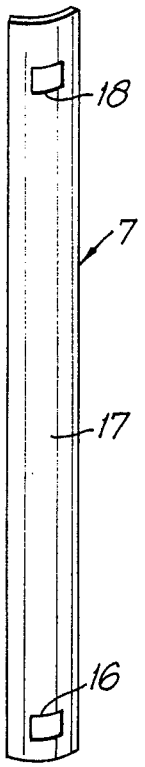
FIG. 9 is a plan view of an insulated bowed tape antenna, from the convex side, when it is not located in the passageway.

FIG. 5 is similar to FIG. 1 except for showing a conductive contact 9 set into the rear wall. This contact is provided locally adjacent the end of the passageway from which the antenna 7 is extended for making an antenna connection and it is connected by a lead (not shown) to the antenna circuit of the radio. A similar contact would also be provided in all the arrangements of FIGS. 2–4. The tape 7 is not insulated on don its convex side where it engages the contact 9, i.e. a window 16 is provided in a layer of insulation 17 on the metal core of the antenna adjacent one end thereof, as shown in FIG. 9, so that when the antenna is fully extended the antenna connection is made by the contact engaging the metal core through the window 16. A similar window 18 may also be provided on the same side adjacent the opposite end of the antenna so that connection may also be made when the antenna is fully retracted. The contact 9 may be biasingly mounted (not shown) in the passageway to provide more positive engagement, and hence a better electrical connection, with the antenna. During extension or retraction of the antenna 7, the contact 9 bears against the insulating material 17 and hence the antenna remains unconnected until it is fully retracted or extended.

Figure 6:
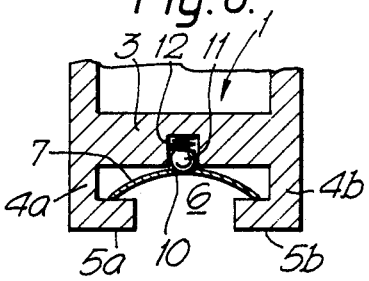
FIG. 6 is similar to FIG. 1, but shows a spring loaded detent for positively locating the tape in a given position.

FIG. 6 is also similar to FIG. 1, except for showing a hole 10 in the tape. The hole is engaged by a spring-loaded ball 11 located in an aperture 12 in a thickened portion of the rear wall 3 of the passageway 6. The hole 10 is located at a position in the tape 7 such that the ball 11 engages the hole 10 when the tape 7 has been extended by a predetermined amount, thereby providing the correct antenna length, at which point the antenna connection has been made e.g. via contact 9 and window 16 as described above. This arrangement provides a positive indication that the antenna 7 has been extended to the correct length. More than one hole may be provided in the tape 7. Instead of a hole or holes 10, the tape 7 may have one or more indentations for the same purpose. In some applications, the spring-loaded balls can be the conductive contact (9) for making the antenna connection.

Figure 7:
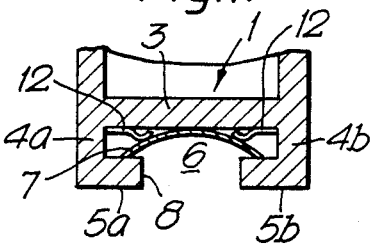
FIG. 7 is similar to FIG. 1 and shows a pair of spring contacts forming part of a switch.

FIG. 7 is similar to FIG. 1 except for showing a pair of spring contacts 12 which make an electrical connection with an uninsulated part of the tape 7, via a window 16 in the insulation 17 (see FIG. 9) when it has been extended by a predetermined amount. The contacts 12 are thereby bridged by the conductive part of the tape 7 when it has been properly extended and they constitute the poles of a switch for connecting the tape antenna 7 to the circuit of the radio in place of an internal antenna (not shown). The contacts 12 or some other form of switch can thereby be used to detect the position of the antenna (at a predetermined extension) in order to switch the RF transmission/reception from an internal antenna to the external antenna when the tape has been extended.

All of the above embodiments have the advantage that the tape antenna 7 has low mass and it can be easily and inexpensively produced. The passageway 6 can also be easily moulded onto the side of a radio casing.

In some applications, a dipole structure is desirable and this may be achieved in two ways. For example, the conductive core of the tape antenna can be separated into two halves and two central RF contacts can be provided for each half. One half of such an antenna may remain in, or be built into the radio case, whilst the other half could then be extendible from the radio casing. Such a dipole could be operable (e.g. switched into operation) when the extendible half is pulled into its correct position. Alternatively, one half of the dipole may be the whole tape antenna (with a single contact therefor), whilst the other half is formed within the case in the form of, for example, a metallic plate or coating on an inner surface of the radio casing.

Figure 11:
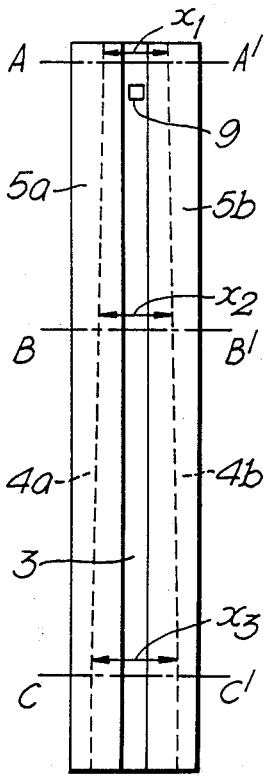
FIG. 11 is a plan view of a tapering passageway for a tape antenna.
Figure 12A:
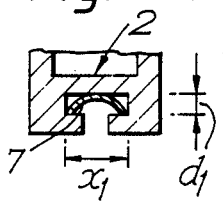
FIGS. 12*a*, 12*b*, and 12*c* are cross-sections of the passageway taken on lines A—A', B—B', and C—C' respectively in FIG. 11.
Figure 12B:
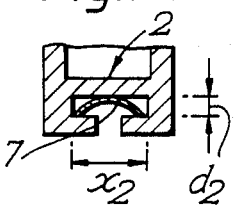
Figure 12C:
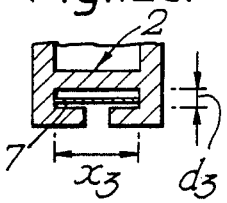
Figure 10:
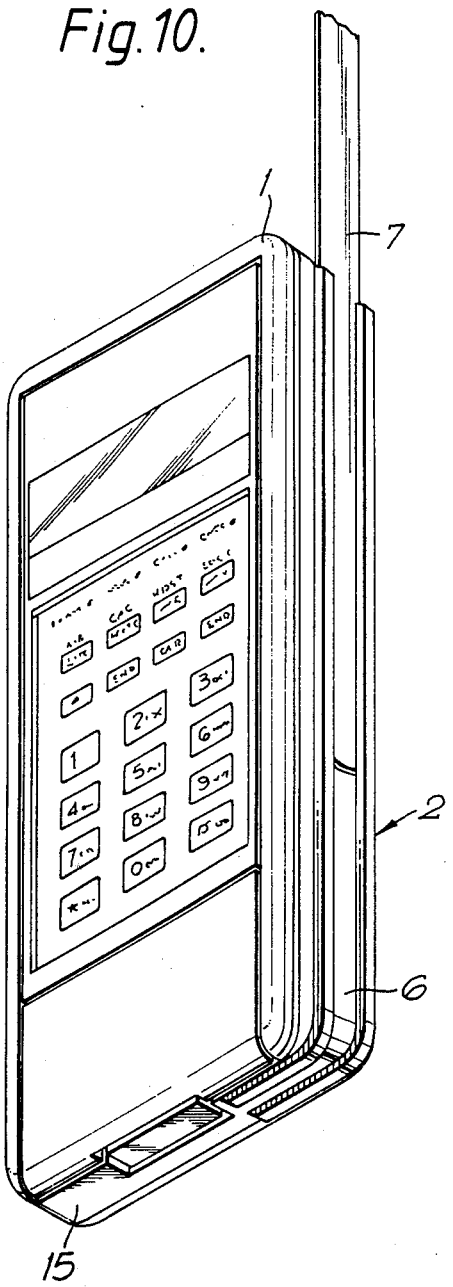
FIG. 10 is a perspective view of a portable radio telephone incorporating a tape antenna in accordance with the invention.

The various tape antennae embodiments described above may be incorporated in a portable radio telephone as shown in FIG. 10. The tape antenna 7 is mounted slidably in a passageway 6 on the side of the telephone 1. The antenna may be longer than the overall height of the telephone casing 1 and so the passageway 6 may extend onto the underside 15 of the radio so as to bend the antenna round the profile of the casing. To aid this bending of the antenna in the length direction around the casing, the transverse bend in the antenna 7 may gradually be reduced away from the end of the passageway from which the antenna is extended, even to the extent that it may become completely flat as it approaches the underside of the radio casing. The passageway 6 may thus have a tapering configuration as shown in FIGS. 11 and 12. Thus at the top end of the passageway (the end from which the antenna is extended) adjacent the contact 9 the width $x_1$ of the passageway is at its smallest and the depth $d_1$ is at its greatest so that the antenna 7 has its maximum cross-sectional curvature, as shown in FIG. 12*a*. Descending the passageway the width $x_2$ is gradually enlarged and the depth $d_2$ is gradually reduced to reduce the curvature of tape 7, see FIG. 12*b*. These dimensions may be further gradually enlarged and reduced respectively until the tape 7 eventually lies completely flat—as shown by $x_3$ and $d_3$ in FIG. 12*c* to enable the tape to be bent more easily around the underside of the radio as shown in FIG. 10.

In view of the foregoing description it will be evident to a person skilled in the art that various modifications may be made within the scope of the invention. For example the transverse bend in the tape may take on various configurations other than those specifically mentioned herein. Furthermore, the tape itself may have a telescopic structure. This offers an alternative way of implementing an arrangement where the antenna needs to be longer than the longest dimension of the radio, but without bending the tape around the casing thereof. Hence the passageway for the tape need not extend onto the underside of the radio casing, but may simply extend along one wall (the side thereof) and the same holds true when the antenna length is not, or substantially not, longer than the height of the radio. Also, it is not necessary for the passageway to have an opening, but instead the passageway may fully enclose the antenna except at the end from which the antenna is extended. To this end the passageway may be provided with e.g. a semi-circular recess forming a thumb hole and/or the antenna may have a flattened end or be provided with a knob or button to enable the user to grasp the antenna more easily.

We claim:

1. An antenna assembly comprising an antenna support and an antenna retractably mounted at least partially within said support, the antenna being in the form of a tape, the support defining a passageway in which the tape is slidably received, and contact means for making electrical connection to the antenna being provided on the support in the passageway, wherein the tape, and passageway are shaped so as to impose a bend transversely across the tape at least in the region of the contact means such that the convex side of the tape confronts the contact means and rigidity is imparted to the tape when extended from the passageway.

2. An antenna assembly as claimed in claim 1, wherein the contact means are resiliently biased against the antenna.

3. An antenna assembly as claimed in claim 1 wherein the passageway has at least one dimension which tends to distort the cross-section of the tape.

4. An antenna assembly as claimed in claim 1, wherein the contact means is disposed locally adjacent the end of the passageway from which the antenna is extendible and the antenna is provided with an insulating coating, a window being present in the coating on the convex side of the antenna adjacent one end thereof to permit the contact means to make the antenna connection when the antenna is fully extended.

5. An antenna assembly as claimed in claim 4, wherein a further window is provided in the coating on the convex side of the antenna adjacent the opposite end thereof to permit the contact means to make the antenna connection when the antenna is fully retracted.

6. An antenna assembly as claimed in claim 1, wherein means are provided for engaging the tape at a predetermined position or positions along its length to positively locate the tape at a predetermined extended position.

7. An antenna assembly as claimed in claim 1, wherein the passageway is adapted ti impose along its length a gradually increasing curvature of the bend in the tape towards the end of the passageway from which the antenna is extendible.

8. A ratio having a main casing and incorporating the antenna assembly according to claim 1, said passageway being defined by walls which are integral with said main casing.

9. A radio as claimed in claim 8 wherein the passageway is adapted to bend the antenna in the length direction around the profile of the casing when the antenna is or is being retracted.

10. A radio as claimed in claim 8, wherein at least one switching means is provided at said passageway for detecting the position of an antenna slidably received in said passageway, the radio also incorporating an internal antenna and the switching means being operable to switch connection between said slidable antenna and said internal antenna to a circuit of the radio depending on the extent of extension of said slidable antenna from said passageway.

11. An antenna assembly as claimed in claim 2, wherein the passageway has at least one dimension which tends to distort the cross-section of the tape.

12. An antenna assembly as claimed in claim 2, wherein the contact means is disposed locally adjacent the end of the passageway from which the antenna is extendible and the antenna is provided with an insulating coating, a window being present in the coating on the convex side of the antenna adjacent one end thereof to permit the contact means to make the antenna connection when the antenna is fully extended.

13. An antenna assembly as claimed in claim 11, wherein the contact means is disposed locally adjacent the end of the passageway from which the antenna is extendible and the antenna is provided with an insulating coating, a window being present in the coating on the convex side of the antenna adjacent one end thereof to permit the contact means to make the antenna connection when the antenna is fully extended.

14. An antenna assembly as claimed in claim 13, wherein a further window is provided in the coating on the convex side of the antenna adjacent the opposite end thereof to permit the contact means to make the antenna connection when the antenna is fully retracted.

15. An antenna assembly as claimed in claim 14, wherein means are provided for engaging the tape at a predetermined position or positions along its length to positively locate the tape at a predetermined extended position.

16. An antenna assembly as claimed in claim 15, wherein the passageway is adapted to impose along its length a gradually increasing curvature of bend in the tape towards the end of the passageway from which the antenna is extendible.

17. A radio having a main casing and incorporating the antenna assembly according to claim 16, said passageway being defined by walls which are integral with said main casing.

18. A radio claimed in claim 17 wherein the passageway is adapted to bend the antenna in the length direction around the profile of the casing when the antenna is retracted or is being retracted.

19. A radio as claimed in claim 9, wherein at least one switching means is provided at said passageway for detecting the position of an antenna slideably received in said passageway, the radio also incorporating an internal antenna and the switching means being operable to switch connection between said slideable antenna and said internal antenna to a circuit of the radio depending on the position of said slidable antenna in said passageway.

20. A radio as claimed in claim 18, wherein at least one switching means is provided at said passageway for detecting the position of an antenna slideably received in said passageway, the radio also incorporating an internal antemma and the switching means being operable to switch connection between said slidable antenna and said internal antenna to a circuit of the radio depending on the position of said slidable antenna in said passageway.

* * * * *